US008286620B2

(12) United States Patent
Williford

(10) Patent No.: US 8,286,620 B2
(45) Date of Patent: Oct. 16, 2012

(54) APPARATUS AND METHOD FOR ADAPTING A PNEUMATIC GUN TO FIRE FROM A FLUID SOURCE

(76) Inventor: Mark Williford, Philadelphia, PA (US)

( * ) Notice: Subject to any disclaimer, the term of this patent is extended or adjusted under 35 U.S.C. 154(b) by 0 days.

(21) Appl. No.: 12/802,002

(22) Filed: May 26, 2010

(65) Prior Publication Data

US 2011/0290227 A1 Dec. 1, 2011

(51) Int. Cl.
*F41B 11/26* (2006.01)

(52) U.S. Cl. ..... 124/74; 124/75; 124/56

(58) Field of Classification Search ..... 124/73, 124/74, 56; 137/798, 68.23
See application file for complete search history.

(56) References Cited

U.S. PATENT DOCUMENTS

| | | | | |
|---|---|---|---|---|
| 1,743,576 | A * | 1/1930 | Smith | 124/72 |
| 2,526,018 | A * | 10/1950 | Foster et al. | 124/73 |
| 2,960,977 | A * | 11/1960 | Moorhead, Jr. | 124/70 |
| 3,018,769 | A * | 1/1962 | Parsoneault | 124/75 |
| 3,192,915 | A * | 7/1965 | Norris et al. | 124/77 |
| 3,216,423 | A * | 11/1965 | Blonsky et al. | 606/121 |
| 3,288,127 | A * | 11/1966 | Bullock | 124/73 |
| 3,379,163 | A * | 4/1968 | Wiethoff | 114/238 |
| 3,507,264 | A * | 4/1970 | Cupps et al. | 124/61 |
| 3,525,319 | A | 8/1970 | Waldeisen | |
| 3,633,560 | A * | 1/1972 | DeFreitas | 124/56 |
| 3,640,263 | A * | 2/1972 | Rhodes | 124/75 |
| 3,662,729 | A * | 5/1972 | Henderson | 124/73 |
| 3,838,676 | A * | 10/1974 | Kahelin | 124/75 |
| 3,989,027 | A * | 11/1976 | Kahelin | 124/58 |
| 4,137,893 | A * | 2/1979 | Beauchamp | 124/72 |
| 4,332,234 | A * | 6/1982 | Allen | 124/73 |
| 5,143,256 | A * | 9/1992 | Wadensten | 222/3 |
| 5,341,790 | A | 8/1994 | Ebert | |
| 5,365,913 | A * | 11/1994 | Walton | 124/75 |
| 5,647,338 | A * | 7/1997 | Martin | 124/75 |
| 5,771,621 | A * | 6/1998 | Rogers | 42/55 |
| 5,839,422 | A * | 11/1998 | Ferris | 124/53.5 |
| 6,202,636 | B1 * | 3/2001 | O'Brien | 124/71 |
| 6,276,353 | B1 * | 8/2001 | Briggs et al. | 124/71 |
| 6,532,947 | B1 * | 3/2003 | Rosa et al. | 124/56 |
| 6,543,475 | B2 * | 4/2003 | Colby | 137/505.25 |

(Continued)

FOREIGN PATENT DOCUMENTS

JP 01179898 A * 7/1989

OTHER PUBLICATIONS

Paintball Gun Adapters Recalled by RAP4 Due to Impact and Laceration Hazards, Jul. 2, 2008.*

*Primary Examiner* — Michael David
(74) *Attorney, Agent, or Firm* — Matthew P. Frederick; Reed Smith LLP

(57) ABSTRACT

Embodiments of the present disclosure include an apparatus including a tank for pneumatic gun comprising a fluid outlet, including an adapter that includes a first end attached to the tank, a second end comprising a fitting, wherein the fitting is capable of receiving a fluid hose, wherein the fluid hose is connected to a source of compressed fluid. The apparatus allows the gun to be fired from the source of compressed fluid. Other embodiments include a method of connecting the apparatus to a pneumatic gun, attaching the fluid hose to the fitting, and firing the gun.

4 Claims, 5 Drawing Sheets

U.S. PATENT DOCUMENTS

Figure 1:
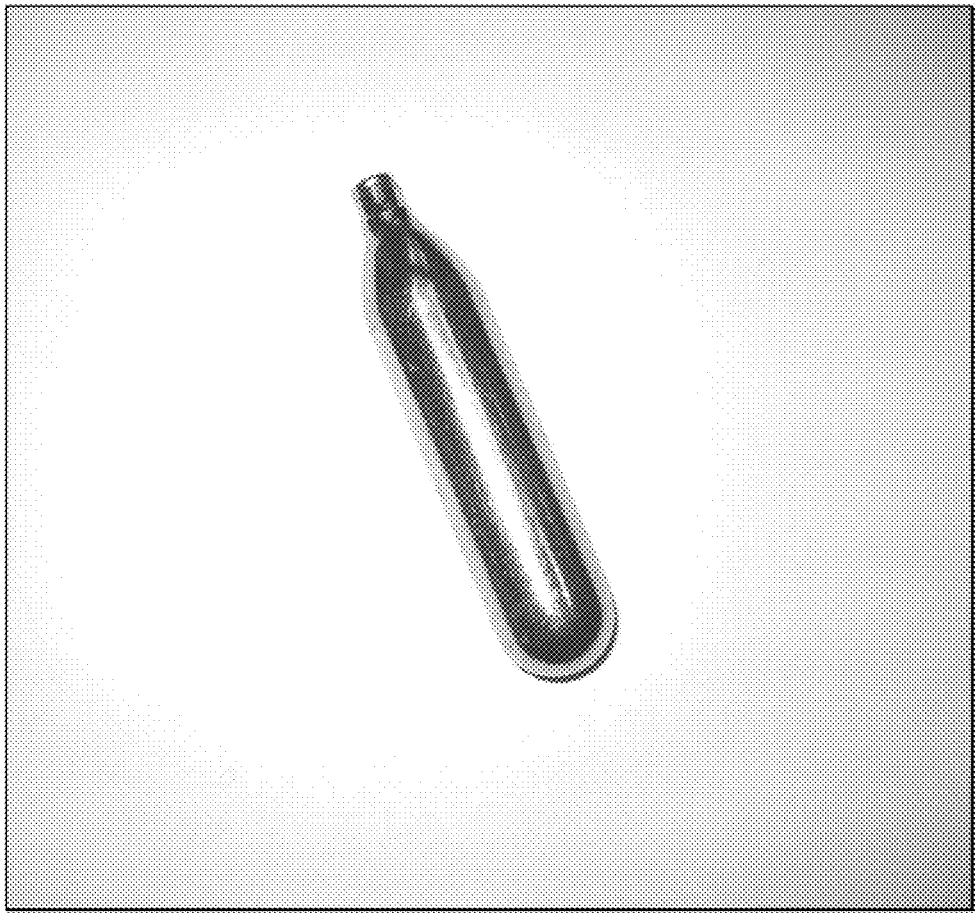

| | | | | |
|---|---|---|---|---|
| 6,886,448 | B2 * | 5/2005 | Urvoy | 89/37.07 |
| 7,617,818 | B1 * | 11/2009 | Túrchik et al. | 124/64 |
| 7,757,681 | B2 * | 7/2010 | Gabrel | 124/73 |
| 2003/0005917 | A1 * | 1/2003 | Kim | 124/59 |
| 2003/0034021 | A1 * | 2/2003 | Gabrel | 124/71 |
| 2003/0116189 | A1 * | 6/2003 | Liang | 137/68.23 |
| 2005/0115549 | A1 * | 6/2005 | Jones | 124/56 |
| 2005/0188979 | A1 * | 9/2005 | Berry | 124/76 |
| 2006/0249132 | A1 * | 11/2006 | Gabrel | 124/70 |
| 2008/0210210 | A1 * | 9/2008 | Colby | 124/73 |
| 2009/0229591 | A1 * | 9/2009 | Gabrel | 124/73 |
| 2009/0283084 | A1 * | 11/2009 | Tran | 124/74 |

* cited by examiner

APPARATUS AND METHOD FOR ADAPTING A PNEUMATIC GUN TO FIRE FROM A FLUID SOURCE

I. FIELD OF THE INVENTION

The invention relates to an apparatus for adapting a pneumatic gun to be fired from a fluid hose instead of a fluid tank for a pneumatic gun, for example, a Powerlet.

II. BACKGROUND

Pneumatic guns use a compressed fluid, usually air or CO2, to propel a projectile down the barrel of the gun. Pneumatic guns come in many shapes and sizes. Some pneumatic guns are "pump style," requiring the user to use lever force to input and compress ambient air. Others use compressed fluid tanks or cartridges that are mated with the gun, wherein the compressed fluid is transferred from the tank to the gun. For example, a Powerlet cartridge is a small disposable metal container holding 12 grams of liquid CO2 and often a small quantity of oil, used as a power source for certain air guns, paintball markers, and a few airsoft guns. Originally developed by Crossman Corporation and introduced to the market in 1954, the Powerlet CO2 cartridge has become the dominant source of power for inexpensive, rapid fire air guns from many manufacturers. The Powerlet container typically lasts between 20 and 40 shots depending on the gun and environmental conditions. You normally get about 10 average shots from a new bottle, then every shot after that becomes less powerful. Today, for paintball markers, this technology is considered outdated. Modern CO2 guns may still use the Powerlet, but also use a variety of fluid tanks containing CO2 and other fluids in various shapes and sizes. For example, many paint ball guns currently use a 12 oz or 20 oz aluminum CO2 tank can. The 12 g Powerlet cartridge is still favored for paintball and bb pistols, and offer considerable weight savings over a modern high pressure air tank.

III. SUMMARY OF THE INVENTION

Embodiments of the present disclosure include an apparatus including a tank for pneumatic gun comprising a fluid outlet, wherein the pneumatic gun is selected from the group consisting of a bb gun, a pellet gun, a paintball gun, a potato gun, a water gun, and a ball gun. The tank includes an adapter that includes a first end attached to the tank, a second end comprising a fitting, wherein the fitting is capable of receiving a fluid hose, wherein the fluid hose is connected to a source of compressed fluid. The adapter further includes a bore extending from the first end to the second end, wherein when the fluid hose is attached to the fitting, the compressed fluid from the fluid hose travels from the second end of the fitting, through the bore to the first end of the fitting, and further into the tank, and out of the tank and into the gun through the fluid outlet.

Other embodiments of the present disclosure include a method including connecting an apparatus as described above to a pneumatic gun selected from the group consisting of a bb gun, a pellet gun, a paintball gun, a potato gun, a water gun, and a ball gun, attaching the fluid hose to the fitting, and firing the gun.

IV. DESCRIPTION OF THE FIGURES

Figure 2:
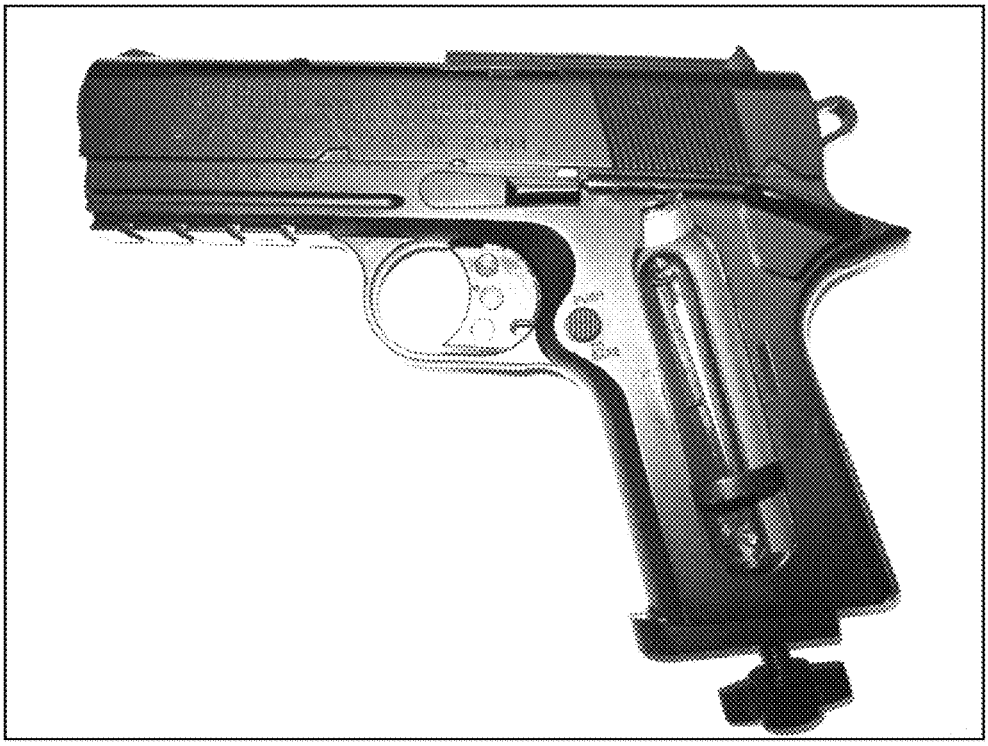
Figure 3:
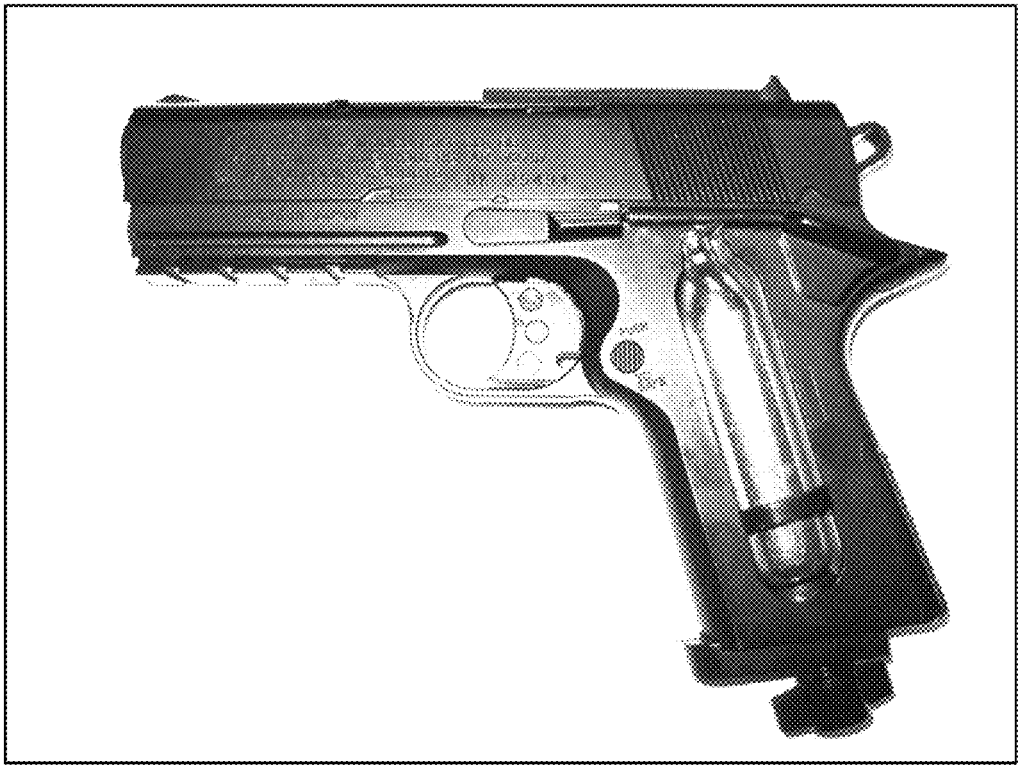
Figure 4A:
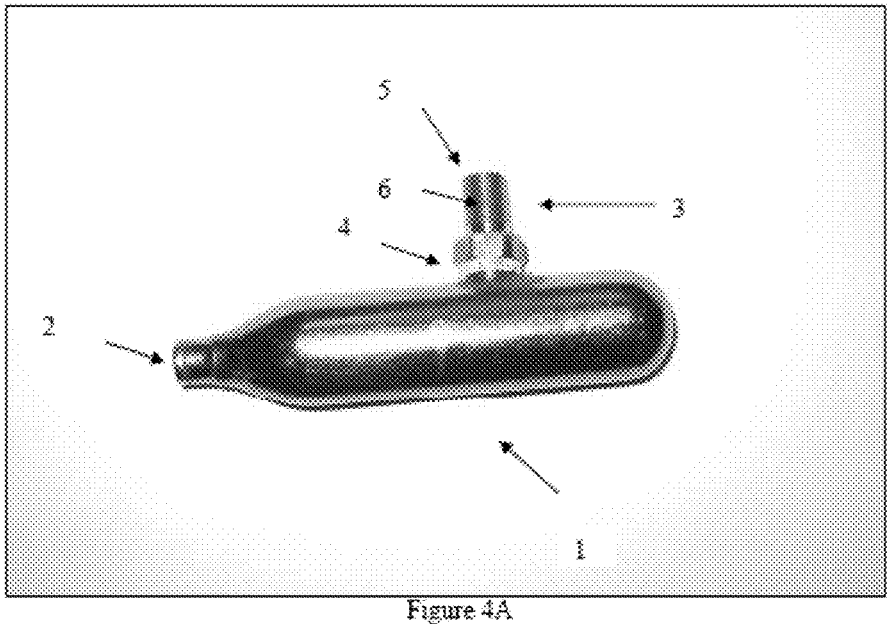
Figure 4B:
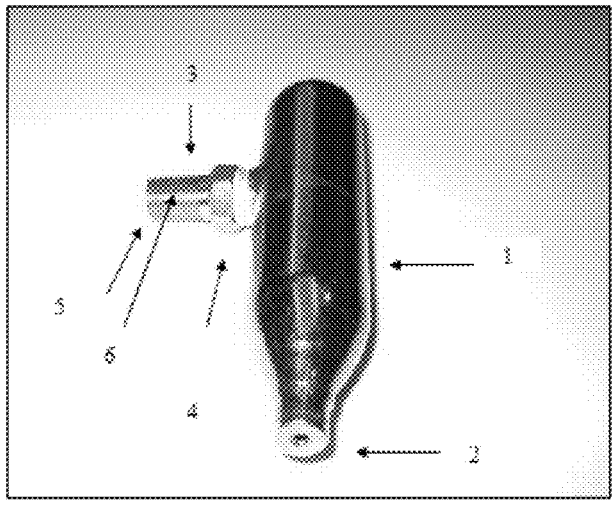
Figure 5:
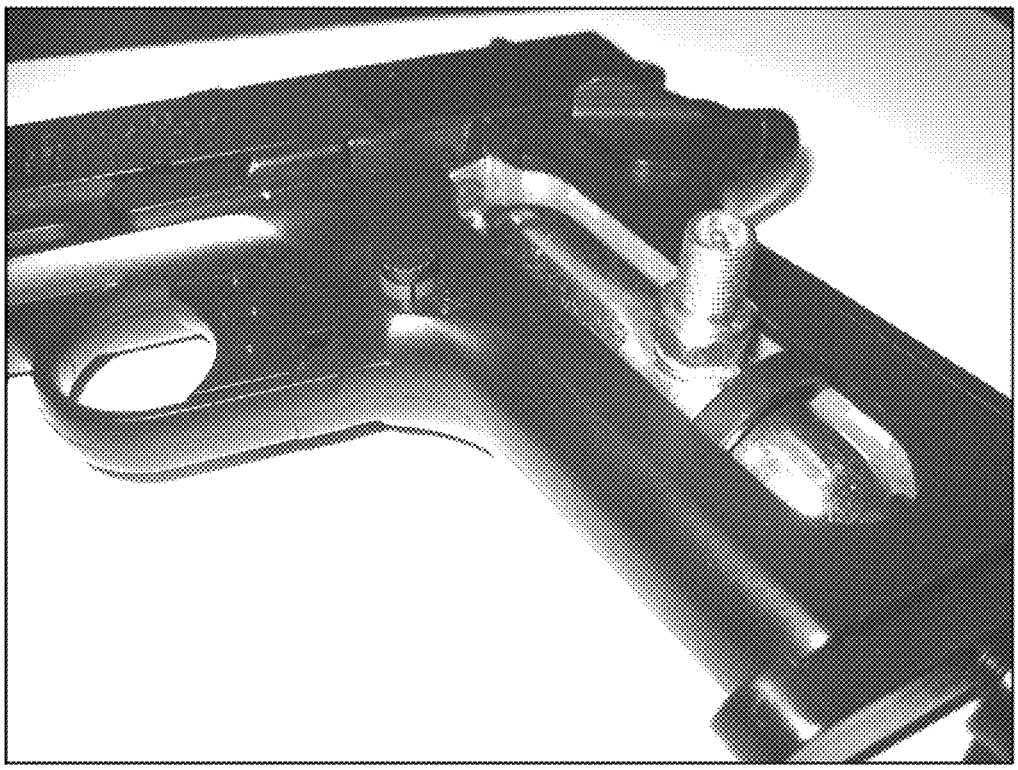

FIG. 1—shows a picture of a 12 g Powerlet;

FIG. 2—shows a picture of a pneumatic gun, in this case a bb pistol, with the Powerlet cover removed, and no Powerlet installed;

FIG. 3—shows a picture of a 12 g Powerlet installed in the bb pistol of FIG. 2 in firing position;

FIGS. 4A and 4B—shows a picture of an embodiment of the apparatus of the present disclosure; and FIG. 5—shows a picture of the apparatus depicted in FIGS. 4A and 4B installed in the bb pistol of FIG. 2 in firing position, however, without a fluid hose attached to the adapter.

V. DETAILED DESCRIPTION

Numbers in the present disclosure are rounded to the nearest significant figure using conventional rounding techniques. Ranges of numbers contained herein are understood to contain the numbers on the upper and lower limits, unless otherwise indicated. For instance, a range "from 1 to 10" is understood to include a range including the number "1," and up to and including the number "10."

As used herein, the term "pneumatic gun" refers to any gun that uses a fluid to propel a projectile. As used herein, the term "fluid" refers to a liquid or gaseous substance. A traditional 12 g Powerlet cartridge, for instance, contains CO2 that is liquid inside the cartridge, but gaseous once it enters the gun to propel the projectile. The present disclosure describes a reusable fluid tank adapter. The fluid tank adapter provides a convenient way of firing pneumatic guns that use a tank system for fluid delivery without needing to repeatedly change depleted tanks. Specifically, this device is useful in a laboratory environment such as a crime lab where pneumatic guns must be tested often, and a fluid source is readily available. When a traditional fluid tank is used up or spent in a pneumatic gun, the cartridge or tank is useless and is discarded. Thus, in addition to allowing a pneumatic gun to be fired continuously, embodiments of the present disclosure also reduce waste by eliminating spent fluid tanks.

The fluid tank adapter may use a different fluid that what is normally contained in the tanks designed for the gun. Nevertheless, the tank may be adapted to propel ammunition through all pneumatic firearms designed to use fluid tanks.

One embodiment of the present disclosure is depicted in FIGS. 4A and 4B. FIGS. 4A and 4B will be used to illustrate the description of the invention, but is not intended to limit the invention in any way. Embodiments of the present disclosure include an apparatus including a tank 1 for pneumatic gun comprising a fluid outlet 2, wherein the pneumatic gun is selected from the group consisting of a bb gun, a pellet gun, a paintball gun, a potato gun, a water gun, and a ball gun. The tank 1 has a wall that defines a volume of space inside the tank 1, the volume capable of holding a fluid. The tank 1 includes an adapter 3 that includes a first end 4 attached to the tank, a second end 5 comprising a fitting 6, wherein the fitting 6 is capable of receiving a fluid hose, wherein the fluid hose is connected to a source of compressed fluid. The adapter 3 further includes a bore extending from the first end 4 to the second end 5, wherein when the fluid hose is attached to the fitting 6, the compressed fluid from the fluid hose travels from the second end 5 of the adapter 3, through the bore to the first end 4 of the adapter 3, and further into the tank 1, and out of the tank 1 and into the gun through the fluid outlet 2.

In order to use the tank adapter, first the tank cover on the gun needs to be removed. Then, the tank adapter is inserted. In some guns, a screw, lever or other device is used to seat the tank in the gun. In this case, the tank adapter should be seated with the adapter facing away from the gun. Then, an air hose may be attached to the adapter fitting. When the trigger of the gun is depressed, air from the air hose flows into the tank adapter fitting, into the gun through the tank outlet, and propels the ammunition.

In some embodiments, the fitting is capable of removably connecting to the fluid hose. In other words, the hose may be connected to the fitting in a such a way that it may be removed and then reattached at will. For example, this may be accomplished by a screw fitting or a quick release fitting of some sort. In further embodiments, the fluid outlet is capable of removably connecting to the pneumatic gun. In other words, the tank adapter is able to be installed in a gun, removed, and reinstalled. Each time the tank adapter is installed, it is operable when connected to a fluid supply. In still further embodiments, the fluid tank for a pneumatic gun is selected from the group consisting of a Powerlet and an aluminum tank for a paintball gun.

In these embodiments, the fluid from the fluid source is selected from the group consisting of carbon dioxide, air, nitrogen, argon, helium, neon, oxygen, hydrogen, and mixtures of any thereof. In a preferred embodiment, the compressed fluid comprises air, and the source of the compressed fluid comprises an air compressor. For example, an air hose may be attached at one end to a standard air compressor, and at the other end to the fitting on the adapter. The compressed air from the air compressor ultimately propels the ammunition in the gun when it is fired.

Other embodiments of the present disclosure include a method including connecting an apparatus as described above to a pneumatic gun selected from the group consisting of a bb gun, a pellet gun, a paintball gun, a potato gun, a water gun, and a ball gun, attaching the fluid hose to the fitting, and firing the gun.

EXAMPLE

The adapter embodiment depicted in FIG. 4 has an air intake valve (commonly found on a vehicle/bicycle tire), so that a fluid may be introduced to the tank.

Approximately 1 inch up from the bottom of the tank adapter, a hole (5/16 in diameter) was drilled into the cylinder's outer shell. Once the hole was drilled and reamed for burs or fragments, the hole was threaded by a tool and die to seat the intake adapter (previously mentioned). The intake adapter was then screwed into the body of the C02 cartridge with plumber's tape to form a tight seal.

The tank adapter was then field tested using the following method:

(1) Remove side grip panel of Powerlet channel in a pneumatic gun;
(2) Place tank adapter with adapter side facing out in to Powerlet channel;
(3) Set bottom screw to seat the tank adapter in the gun;
(4) Load gun with appropriate ammunition;
(5) Attach air supply to the adapter;
(6) Depress trigger;
(7) After firing, detach air supply; and
(8) Unseat and remove tank adapter.

The gun used was a Powerline, model 15xt, C02 BB, .177 caliber (4.5 mm) shown in FIG. 2. The air source was a traditional "pancake style" air compressor with an approximately 135 PSI max range and a traditional air supply hose (portal cable). The BB gun fired all the loaded .177 BB's at a consistent velocity. This observation was based on the consistent penetration of a target box.

It is believed that a comparison test comparing a projectile fired with the present invention, the velocity of the projectile fired with the present invention would show that with the application of a controlled and consistent air supply from the tank adapter and air compressor, the velocity could be adjusted to be less than, approximately equal to, or greater than that of a traditional cartridge. The performance of the gun with the adapter may be more consistent then a traditional C02 cartridge which may lose pressure with every shot. The present invention may allow for more consistent air pressure then that of a CO2 cartridge.

At no time during the test phase of this embodiment of the present invention did the pressure decrease to a point where the firearm did not function. Additionally, it was found that as long as the firearm was loaded all the shots were consistent.

The present invention may be embodied in other specific forms without departing from its essential characteristics. The described embodiments are to be considered in all respects only as illustrative and not as restrictive. The scope of the present invention is, therefore, indicated by the appended claims rather than by the foregoing description. All changes which come within the meaning and range of the equivalence of the claims are to be embraced within their scope.

I claim:

1. A method of firing a projectile using an air compressor, comprising:

connecting an apparatus to a fluid-cartridge fired pneumatic gun selected from the group consisting of a bb gun, a pellet gun, a paintball gun, a potato gun, a water gun, and a ball gun, the apparatus taking the place of the fluid cartridge, the apparatus comprising:

a tank for the pneumatic gun comprising a fluid outlet; and an adapter, comprising:

a first end attached to the tank;

a second end comprising a fitting, wherein the fitting is capable of receiving a fluid hose; and a bore extending from the first end to the second end, connecting a first end of the fluid hose to the fitting and a second end of the fluid hose to an air compressor, wherein when the fluid hose is attached to the fitting and a trigger is depressed, compressed air from the fluid hose travels from the second end of the fitting, through the bore to the first end of the fitting, and further into the tank, and out of the tank and into the gun through the fluid outlet.

2. The method of claim 1, wherein the fitting is capable of removably connecting to the fluid hose.

3. The method of claim 1, wherein the fluid outlet is capable of removably connecting to the pneumatic gun.

4. The method of claim 1, wherein the fluid tank for a pneumatic gun is selected from the group consisting of an empty Powerlet cartridge and an aluminum tank for a paintball gun.

* * * * *